US006948779B2

(12) United States Patent
Ehler et al.

(10) Patent No.: US 6,948,779 B2
(45) Date of Patent: Sep. 27, 2005

(54) CUTTING ROLLER FOR A CONTINUOUSLY OPERATING SURFACE MINER

(75) Inventors: Alexander Ehler, Dresden (DE); Günter Kunze, Freital (DE); Volkmar Schrader, Schwarzheide (DE); Burkhard Petack, Senftenberg (DE); Klaus Potenberg, Kleinkoschen (DE)

(73) Assignee: MAN Takraf Fördertechnik GmbH, Leipzig (DE)

( * ) Notice: Subject to any disclaimer, the term of this patent is extended or adjusted under 35 U.S.C. 154(b) by 0 days.

(21) Appl. No.: 10/671,125

(22) Filed: Sep. 25, 2003

(65) Prior Publication Data

US 2004/0124691 A1 Jul. 1, 2004

(30) Foreign Application Priority Data

Sep. 28, 2002 (DE) ..... 102 45 394

(51) Int. Cl.[7] ..... E21C 25/10
(52) U.S. Cl. ..... 299/39.4; 299/39.2
(58) Field of Search ..... 299/39.3, 39.4, 299/39.1, 39.2, 64, 65

(56) References Cited

U.S. PATENT DOCUMENTS

| | | | | |
|---|---|---|---|---|
| 2,184,108 | A | * 12/1939 | Akeyson | 175/344 |
| 6,224,163 | B1 | * 5/2001 | Nies et al. | 299/39.2 |
| 2001/0038236 | A1 | 11/2001 | Hoffmann | |

FOREIGN PATENT DOCUMENTS

| | | |
|---|---|---|
| DE | 36 44 945 | 3/1988 |
| DE | 100 19 748 | 9/2001 |
| DE | 199 41 801 | 9/2001 |
| DE | 101 58 603.5 C1 | 6/2003 |
| GB | 2035417 * | 6/1980 |

OTHER PUBLICATIONS

Saprykin et al., Mar./Apr. 1997, Konstruktive und verfahrenstechnische Voraussetzungen und . . . , *Braunkohle, Surface Mining*, vol. 49.

Dr.–Ing. habil et al., Feb. 1989, Walzenschrämlader mit glatten Disken zur Kohlengewinnung, *Bergbau*, vol. 40.

Spachtholz et al., Mar./Apr. 1997, Einsatzmöglichkeiten des Surface Miners und erste . . . , *Braunkohle, Surface Mining*, vol. 49.

G. Gunze, A. Ehler, B. Goericke, Apr./Jun. 2001, Continuous Mining Process in Solid Rock, *Surface Mining Braunkohle & Other Minerals*.

* cited by examiner

*Primary Examiner*—Sunil Singh
(74) *Attorney, Agent, or Firm*—McGlew and Tuttle, P.C.

(57) ABSTRACT

A mining member designed as a cutting roller for a continuously operating surface miner for mining mineral raw materials of high strength. The roller body is equipped for this purpose with mini-disk bits of identical design. Since different conditions occur over the entire width of the roller during the separation of the material from the soil, the roller body is designed correspondingly, and the arrangement of the mini-disk bits is adapted to these conditions. The mini-disk bits in the edge areas are placed at a greater density than are the mini-disk bits (7) in the middle area. In addition, mini-disk bits are directed obliquely toward the outside as free-cutting bits at the two outer edges of the cutting roller. The height of the mini-disk bits is selected to be such that their individual virtual rolling paths together form a virtual cutting roller body, which comprises a middle cylinder, which is joined on both sides by outwardly tapering frusta. This solution is associated with the advantages that more mini-disk bits are available per unit area in the critical edge areas for separating the material and for cutting the roller free, and the cutting height $H_{Schn}$ is smaller there.

17 Claims, 5 Drawing Sheets

CUTTING ROLLER FOR A CONTINUOUSLY OPERATING SURFACE MINER

FIELD OF THE INVENTION

The present invention pertains to a mining member designed as a cutting roller for a continuously operating surface miner. Such a cutting roller is especially suitable for use for mining high-strength mineral raw materials such as hard coal, ores, etc., with compressive strengths between 50 and 140 MPa by means of surface miners. However, it may also be used in rotary cutters for road construction and breakers.

BACKGROUND OF THE INVENTION

When a surface miner is used as surface mining equipment with a roller-shaped mining member (a frontal mining portion that is attached via a support to a caterpillar) rotatable around its horizontal axis, the mining operation is carried out, in general, according to the so-called cutting operation. According to its basic concept, the mining member of such a device, as is known from, e.g., the patent DE 199 41 801 C2, has a roller width that is greater by a factor of 5 to 8 (as a result of which it can also be defined as a cutting roller as opposed to cutting drill) than that of the cutter loader known from underground mining. The mining member is equipped with bits, and the type of the bits, their number and their arrangement in relation to one another are provided according to the so-called cutting operation. The cutting geometry of each bit is optimized for particular conditions of use. During the separation, each bit creates at the same time a flank for the bit that is displaced in the circumference and follows it in time. The separated material is delivered in the area of the mining member through the screw turns from the outside to the inside to the middle of the turn and subsequently transferred to a removing conveyor. When developing a raw material deposit with a surface miner, the mineral raw materials are mined in blocks. The volume of such a block being mined consists of the mining surface of the mining member, which surface is rectangular in the direction of mining, multiplied by the length of mining. The mining technology for such a device is known from the technical article "Konstruktive und verfahrenstechnische Voraussetzungen und Erfahrungen bei der Eutwicklung eines Surface Miners für den Einsatz in russischen Tagebauen" [Design and technological requirements and experience with the development of a surface miner for use in surface mining in Russia] published in the journal *Braunkohle, Surface Mining,* Vol. 49 (1997), No. 2, pp. 123 to 128. This includes mining only so many blocks next to one another such that the width of the deposit is reached. The subjacent layer is then mined in turn in blocks located next to each other. The mining member cuts itself free with one or more sides from the rock being mined (formation) during the mining operation with a continuously operating surface miner. This free-cutting is associated with a considerably higher energy consumption and wear and calls for special equipment for the mining member with tools in the edge area compared with the rest of the larger middle area. The technical effort needed for the free-cutting of the mining member at its outer edges increases with increasing hardness of the deposit of mineral raw materials. The separated material is partially thrown out on the side by the edge bits at the outer sides of the mining member in the prior-art mining devices. As a result, accumulations are formed over the entire length of the block being mined.

These lead to a reduction in the mining output and require the use of an additional clearing technique. To reduce the accumulations, the surface miner is not operated wit the full roller width on the side of the surface already mined off. As a result, additional losses of output must be accepted. Other drawbacks of such a roller-shaped mining member equipped with round-shaft bits are that high energy losses and intense wear occur on the bits due to the sliding contact of the bits in the case of abrasive earth materials. The specific energy consumption also increases enormously if the compressive strength of the deposits of mineral raw materials is higher than 60 MPa and makes the use of surface miners uneconomical. Another drawback is that pulverized rocks generate increased dust emission during the mining operation. Strong tear-out forces, which lead to the formation of large chunks, are generated on the bits in case of the overshot mining method. This is a considerable obstacle for the entire mechanical mining operation and may lead to a reduction of output, or an additional intermediate breaker becomes necessary.

Disk bits have a rolling contact with the earth material to be mined and subject as a result to a substantially reduced wear compared with the conventional round-shaft bits. The basis for the successful use of the disk bits is the lower tensile strength of the soil compared with the compressive strength, the ratio of the compressive strength to the tensile strength of the soil equaling $\sigma_c/\sigma_t \approx 10$. Due to the use of disk bits, the use of the mining technique can be extended to mineral raw material deposits with a compressive strength of up to 140 MPa. To guarantee the separation in an optimal manner, the rolling disk bits for a surface miner are designed as mini-disk bits and are arranged on the turns of opposite pitch with the driving wedge flanks toward the edges of the tool. As a result, the side forces acting on the tools during the mining operation are eliminated on the two halves of the roller. The conditions of destruction are characterized by substantially higher mining resistances in the edge area because the mining member must cut itself loose at these locations.

Cutter loaders are successfully used in underground mining for mining hard coal, salt and soft ores. The roller-shaped basic body of the cutter loader is equipped with round-shaft or flat bits, which are arranged helically in one or more turns. However, roller-type cutter loaders equipped with disk bits have been known as well. Thus, a cutter loader, over the entire basic body width of which screw turns are arranged and are equipped with disk bits, is known from the article "Walzenschrämlader mit glatten Disken zur Kohlengewinnung" [Roller type cutter loader with smooth disks for mining coal] by Klich A. and Krauze A., published in the journal *Bergbau*, Vol. 40 (1989), No. 2, pp. 51 to 55. The wedge rings on the disk bits are directed in parallel to the vector of the cutting velocity. Conventional or round-shaft bits with a cutting line distance corresponding to 0.4 to 0.8 times the path distance of the disk bits and with reversed pitch angle are fastened in the edge area, so that the free-cutting of the cutter loader is also guaranteed. The entire cutter loader is fastened to a lifting arm. The disk bits are arranged on the screw turns after the free cut to the half-blocked cut. The separation with a disk type cutter loader follows due to the formation of flanks parallel to the path at right angles to the rock surface, and the specified amount of path is separated or split off in the form of large chips or strips. The path distances of 50 mm to 80 mm are characteristic of earth materials such as coal or salt (compressive strength up to 20–30 MPa). The separation of the specific amount of path follows after a roll-over (primary roll-over). The separated material is loaded on the conveyor through the screw turns. The practical embodiment of this known state of the art is shown in the two drawings on page 53 of the above-mentioned article. The disk bits are fastened with their bit holders on the rotating basic body of the cutter loader of a mining machine. The direction in which the disk bits are mounted and the direction of the screw turns on the body of rotation agree. The number of screw turns depends on the mining output and the characteristics of the earth materials. Radial bits are arranged on the circumference of this cutting disk such that their tips point alternatingly to the outside and toward the cutting roller. As a result, penetration in the rock in place is achieved, and flanks are formed for the disk bits of the wall area. The density of the conventional radial bits in a cutting line is at least twice that of the disk bits. To ensure better ejection of the separated material onto the conveyor, additional loading wedges are provided. The standard width of the cutting roller is in the range of 0.63 m to 1.0 m. During the mining operation, the disk bits thus separate the material in the so-called wall area in the direction of feed, and the parting planes between the wall and the bottom or the roof of the longwall is cut by the lateral closing rings (cutting disks) with the conventional bits. An exact longwall edge is necessary for the normal functioning of the removal and the integrated conveyor. Such disk type cutter loaders are well suited for hard coal with hard inclusions and shelves, because the separation operation follows predominantly by overcoming the tensile strength, and the dust emission is substantially reduced due to the material being in the form of large pieces, and the wear on the bit is substantially reduced as well. Due to its narrow design and because the separated material is conveyed on one side only, as well as due to the arrangement of the disk bits after the free cut (as a consequence of which the bit density is relatively high and there are strong pressing forces), these cutter loaders are not suitable for economical use during the mining of hard and thin layers with surface miners because of the insufficient mining output. The formation of exact longwall edges requires a high bit density on the lateral closing ring. In addition, the use of two types of bits with closing rings is technologically and economically unfavorable.

Furthermore, the concept of a disk roller for the continuous surface miner, which disk roller is arranged in front of the conventional cutting roller equipped with round-shaft bits, is known from the technical article "Einsatzm öglichkeiten des Surface Miners und erste Erfahrungen auβerhalb der Kohle" [Possible applications of the surface miner and preliminary experience outside coal mining], published in the journal *Braunkohle, Surface Mining*, Vol. 49 (1997), No. 2, pp. 137 to 149 (see FIG. 10). The so-called disk surface miner is the combination of the offset disk row (disk roller) as a main mining unit with a pick-up cutting roller equipped with round-shaft bits. The separated material is sent by this pick-up cutting roller through a chute to a removing conveyor belt in the known manner. The disk bits (also called disks in the source) have a diameter of 430 mm and are arranged on the disk roller in a disk row at a path distance of about 200 mm as well as offset in relation to one another in the direction of mining. All disk bits are continuously in contact with the front being mined during the mining operation and roll at right angles to the surface of the rock. The weight of the surface miner is transmitted uniformly to all disk bits and it thus forms the pressing force. A crushing zone, in which a quasi hydrostatic pressure prevails, is formed under the disk bits. This compressive strain leads to the tensile and shear load on the material under and to the side of the track of the disks. Radial (stress relief) cracks and lateral cracks are formed in the rock formation. These cracks make possible the breaking out of the material to the free surface. Removal that is appropriate for the mining height, precrushing and clearing of the wall surface is accomplished by the pick-up cutting roller. Consequently, two mining members, which are integrated in one machine frame, are necessary for the mining operation. The disk roller has no drive of its own. Considerable pressing forces must be generated to guarantee the separation with the disk bits. It is assumed that the pressing force is generated by the weight of the carrier device and the rolling force by the chassis. The drawbacks of a surface miner based on this concept is that due to the frontal contact of all disk bits with the rock surface with a track distance of 200 mm and rolling over only once, practically no artificial flank can be formed, because a great arc length can be expected in case of a disk diameter of 350–430 mm, which requires an enormously high pressing force for sufficient penetration. Furthermore, the use of two mining members leads to a widening of the distance between the caterpillars and consequently to unfavorable conditions for manoeuvering at the end of the face.

SUMMARY OF THE INVENTION

The basic object of the present invention is to develop a cutting roller for a continuously operating surface miner for mining mineral raw materials possessing solid and abrasive properties, comprising a roller basic body, which is substantially cylindrical and is provided with a drive and is fastened to the surface miner by means of supports. The roller jacket is equipped with mini-disk bits arranged in rolling paths, and conveying screws, which have opposite pitches and extend from the two edges of the roller to the middle of the roller, are arranged, and two roller halves, which are symmetrical to one another, are thus formed, and the mineral raw materials are mined from the soil by the cutting roller in blocks, wherein the larger, middle area is called the mining front, which is joined on both sides by the edge areas. This guarantees, on the one hand, the mining of earth materials of high strength in general with a relatively low specific energy consumption according to the cutting method and is thus suitable for use in surface miners, rotary cutters for road construction or even breakers and, on the other hand, combines in itself the advantages, such as won minerals in the form of coarse lumps because of the splitting breaking operation, low dust emission and high stability due to rolling contact with the rock in place, good service life and mining output due to the reduction of the loss of time for replacing bits (the wear on the disk bits is reduced by a factor of 10) and the avoidance of a lateral accumulation of material having escaped to the outside. The mining member shall be equipped with a simple type of bit and guarantee the generally difficult mining operation in the edge area in a stable manner and shall cleanly clear the separated material.

This object is accomplished with a cutting roller that with a repeatedly blocked separation operation. Screw turns (double helix arrangement) with opposite pitches arranged on the circumference are equipped with mini-disk bits on the roller halves of equal size of the jacket of the cutting roller, and the separation as well as the combined radial and transverse conveying of the separated material is thus guaranteed simultaneously. The driving wedge flanks of the mini-disk bits of one roller half are directed opposite those of the second half of the roller, and the side forces generated are thus eliminated. The screw turns at the edge of each roller half and the basic body of the cutting roller are designed such that the virtual path diameters formed by the mini-disk bits form a truncated cone, and as a result, the surface of the track level forms a trough-shaped profile at right angles to the direction of travel after the separation operation. As a result, less earth material is removed in the area of the frustum of the cone. Lower mining resistances develop there. Furthermore, a smaller volume of separated material, which must be conveyed by the transverse conveying to the middle of the roller, is formed in the edge areas of the cutting roller. A dimension of at least ¼ of the mining height shall be maintained for the width of the frusta at the edge of the cutting roller, because the height of the remaining trough side residues is smaller in the case of this geometry than in the middle of the roller. The two trough side residues located next to each other from two mining directions form together an elevation whose profile converges in an apex. This elevation is removed without problems during the mining of the subjacent block due to the rise, larger deposits are removed with the middle part of the cutting roller, the wall area, and thus it does not have an adverse effect on the overall mining technology. No lateral accumulations are formed during the mining operation due to the laterally directed breaking operation under the wedge flanks of the mini-disk bits and the rolling contact as well as the smaller volume removed in the edge areas and the improved pick-up capacity of the scraper blade in the trough-shaped track level. The mining output increases and the energy consumption is reduced as a result.

To simplify the design of the cutting roller with the double helix arrangement of the conveying screws and the mini-disk bits and to minimize the manufacturing costs, the conveying screws are directed from the edge toward the middle of the roller on each of the two roller halves. Since the separation takes place with a higher mining resistance in the edge area due to the edge effect, at least a double density of disk bits is installed on the edge area in a rolling path by means of shorter additional conveying screws. Due to the double density of mini-disk bits, the penetration in the edge area of the cutting roller is only half the penetration in the area of the middle mining front, the wall area. It is therefore possible to increase the height of the conveying screws in the truncated cone-shaped edge areas by this dimension of smaller penetration of these mini-disk bits arranged in the edge area, and the quality of clearing of the track level and the energy transmission of the mini-disk bits are substantially improved, and a lower specific energy consumption is thus obtained. It is advantageous that the entire cutting roller can be equipped with one type of bits.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
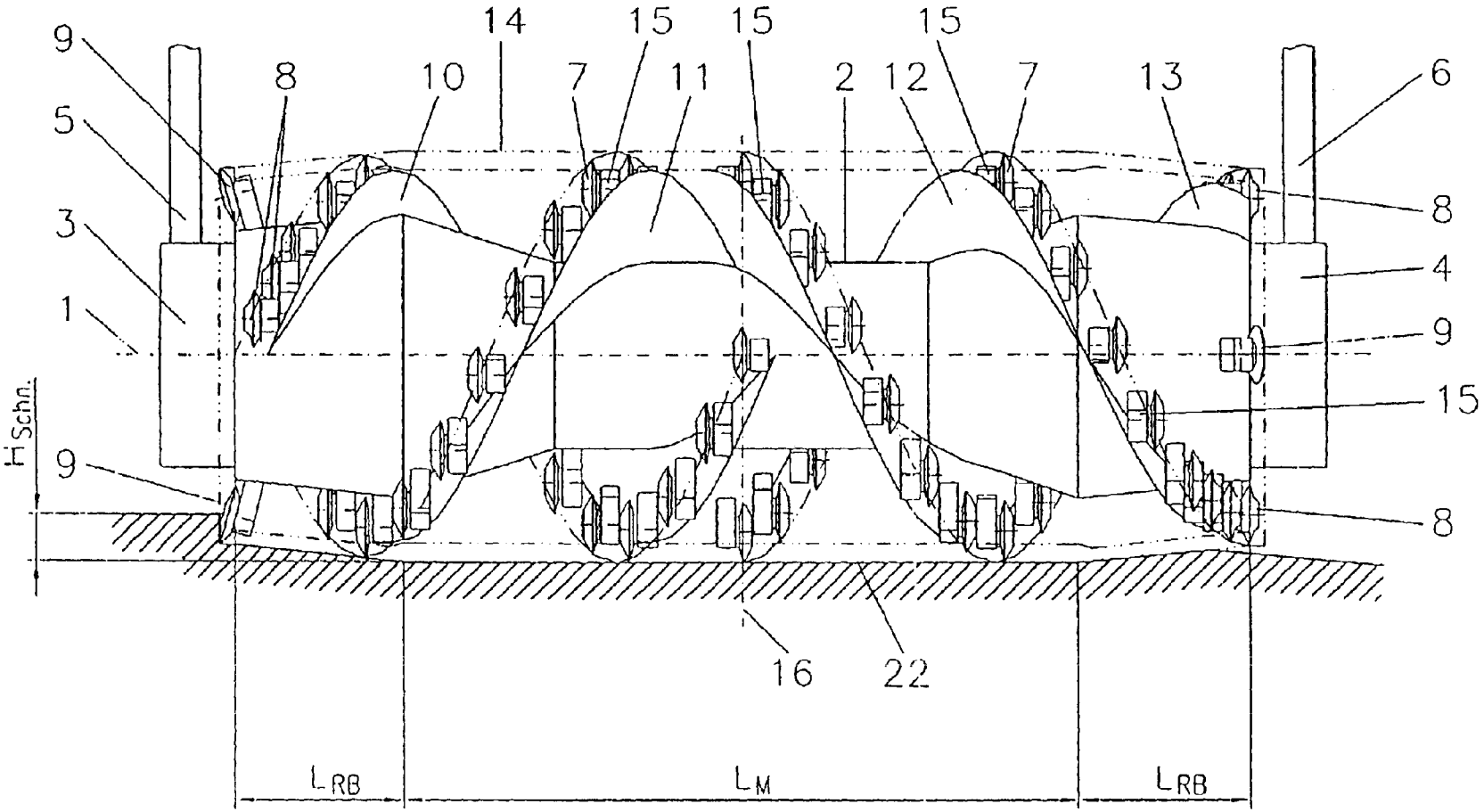
FIG. 1 is a front view of a cutting roller for a surface miner.

Referring to the drawings in particular, the cutting roller shown in FIG. 1 is the mining member for a surface miner for mining earth materials of high strength such as hard coal, ores and other mineral raw materials with high compressive strengths between 50 MPa and 140 MPa. Such a continuously operating surface miner, which is, however, not designed with its mining member for mineral raw materials of such a high compressive strength, is known from, e.g., Patent No. DE 199 41 799 A1. The cutting roller is arranged with its axis of rotation 1 in the horizontal position in front of the device in the mining direction. However, this is not a requirement. It may also be arranged between the front and rear chassis or at the end of the device.

The cutting roller comprises a roller jacket 2, in which a drive 3, 4 each is accommodated on both sides. The cutting roller is fastened to the surface miner by supports 5, 6, which are arranged at the frame of the device on both sides and accommodate the drives 3, 4 at their free lower ends. The feed motion of the cutting roller is generated by the travel motion of the mining device. The cutting roller operates according to the undershot method. The concept of the present invention is also suitable for the overshot mode of operation directed in the opposite direction.

Figure 2:
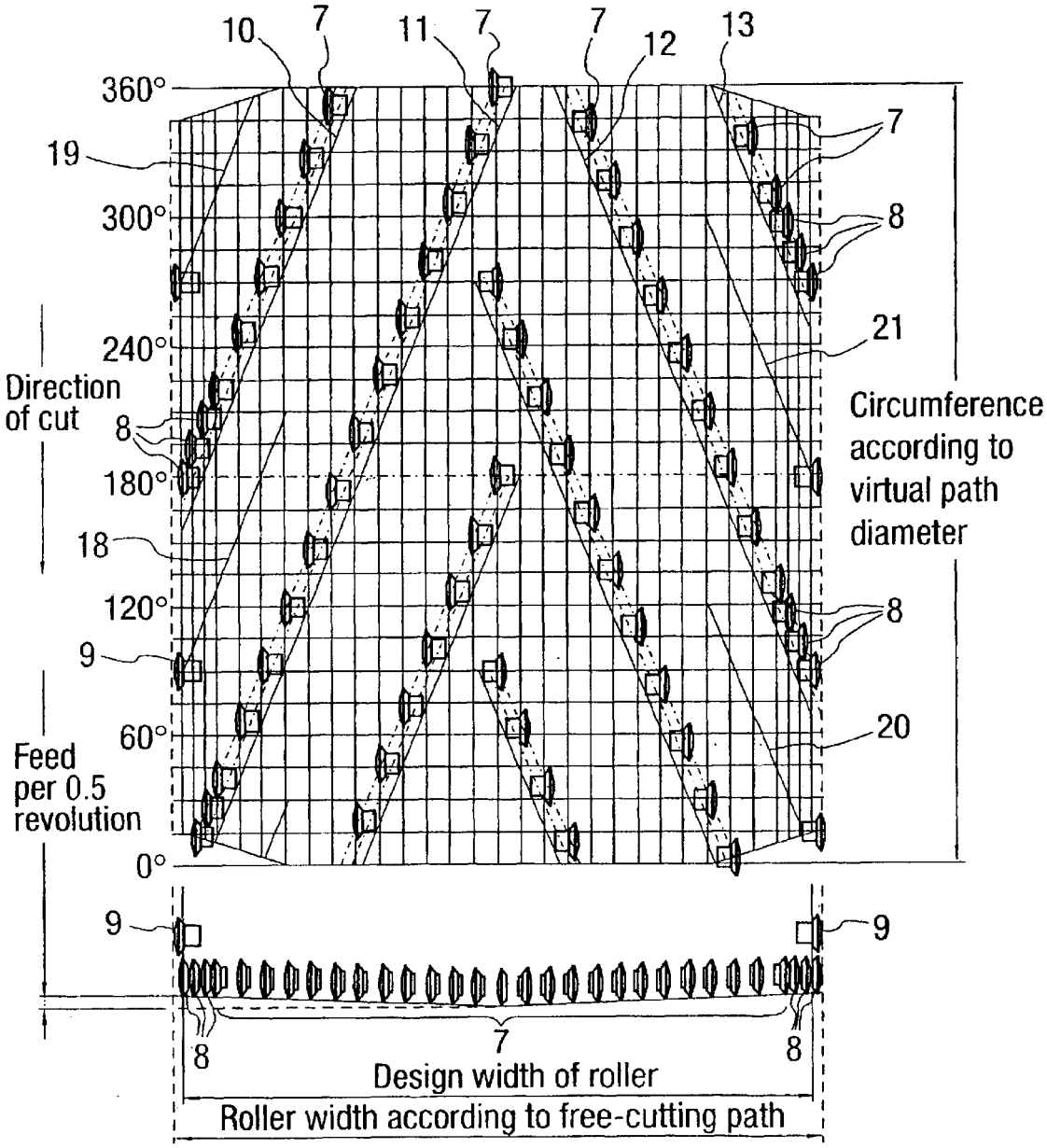
FIG. 2 is a schematic view of the arrangement of the mini-disk bits on the basic body of the cutting roller relative to its lateral distance from the vertical center line of the roller body.

Mini-disk bits 7, 8, 9 and conveying screws 10, 11, 12, 13 are arranged on the circumference of the roller jacket 2 in the manner described below, which is shown in FIGS. 1 and 2. The design known from the patent DE 101 58 603.5 C1 is especially suitable for use as mini-disk bits 7, 8, 9. The conveying screws 10, 11, 12, 13 comprise sheet metal segments, which are welded to the roller jacket 2 at right angles. The roller jacket 2 may be continuously cylindrical in parallel to the axis of rotation 1, but it may also have a larger diameter on both sides than the middle part. The latter design with the stepped jacket, as is shown in the drawing according to FIG. 1, is associated with the advantages that there is a sufficient free space in both outer areas for accommodating the drives 3, 4 in the interior of the roller. By contrast, there is a larger space for the transverse conveying of the separated material between the roller jacket 2 and the virtual path diameter 14 of the mini-disk bits 7, 8, 9 in the middle area with the smaller roller diameter. This is particularly advantageous because this middle area is the area in which the larger amount of material is mined.

The tools and the material guide means are arranged on the circumference of the cutting roller such that optimal separation of the material from the rock formation is possible and the separated parts of material are carried by a combined radial and axial movement from the outer sides of the roller to the middle of the roller, where the material is transferred over a trajectory parabola through a plurality of chutes onto a removing conveyor belt.

A repeatedly blocked separation operation is achieved with the mini-disk bits 7, 8, 9. The peculiarity of this repeatedly blocked separation operation is that the breaking conditions build up only after the bit bodies have rolled over several times with advances due to the feed. The own weight of the mining device is transmitted only to the mini-disk bits 7, 8, 9 that are acting at the moment and the high pressing forces necessary in such tools are thus built up. The installation of the robust bit holders 15 with the mini-disk bit 7, 8, 9 on the conveying screws 10, 11, 12, 13 and consequently the practical embodiment of the rolling mining with a broad mining member are made possible only by the great path distances of the repeatedly blocked separation operation, which are associated herewith. One advantage is that the number of necessary mini-disk bits 7, 8, 9 is substantially reduced due to the great path distances, which also has a highly favorable effect on the build-up of a sufficient pressing force per mini-disk bit 7, 8, 9. Since the feed motion of the entire mining device takes place permanently, the amounts of feed obtained during the subsequent roll-overs lead to an increase in the penetration of the mini-disk bits 7, 8, 9. A historical and permanently increasing load-strain state, which leads to the tensile and shear load on the material under and to the side of the disk track, will develop in the upper soil layer due to the repeated roll-over of the disk wedges in a path. Predominantly radial cracks will develop because of the previously great path distance, by which a blocked breaking state is reached. The cracks become larger during the subsequent roll-overs. Magistral or even expansion cracks develop, which are enlarged by additional roll-overs into stress relief cracks, in which the material breaks out in the free direction of the surface. This is precisely why large broken elements separate with a thickness of S>>p and an arc length after the rolling path that is much greater than 3 to $5t_B$. The roller torque also decreases due to the rolling contact of the mini-disk bits 7, 8, 9. A material in the form of coarse lumps is formed, and the specific energy consumption is low. Energy-saving mining of solid and abrasive earth materials is thus achieved.

Based on the fact that the separation of the mineral raw materials from the solid soil by means of a surface miner is performed by its cutting roller in blocks in a cross section that is rectangular in the direction of mining, zones with different mining conditions can be assumed over the entire width of the cutting roller. The more complicated conditions arise where the cutting roller must cut itself free laterally. The material cannot be separated so easily there in the continuous process as in the middle area. It can be broken out and removed toward one side only. By contrast, the mining conditions are more favorable in the remaining, larger part of the mining cross section. The cutting roller must be adapted to these two different conditions in terms of its geometry and its set of tools and material guide means.

Since free-cutting of the roller body is necessary during the mining process either on both sides or only on one of the two sides of the cutting roller and the separated material is always to be delivered from the two sides to the middle of the roller, the cutting roller has a symmetrical design and is provided symmetrically with tools and material guide means. The middle is marked according to FIGS. 1 and 2 by the mean perpendicular 16. They are thus divided into a left-hand roller half and a right-hand roller half according to the drawings.

The conveying screws 10, 11 and 12, 13 arranged as two-start conveying screws on both halves of the roller jacket 2 are offset by 180° in relation to one another on one half of the drum each. The conveying screws 10 to 12 and 11 to 13 on the left-hand and right-hand drum halves are in turn offset by 90° in relation to one another, so that they do not intersect in the middle. The outer circumference of the conveying screws 10, 11 and 12, 13 is cylindrical in the middle part, as is shown in FIG. 1, and extends on the outside toward both sides as a tapering truncated cone.

Figure 3:
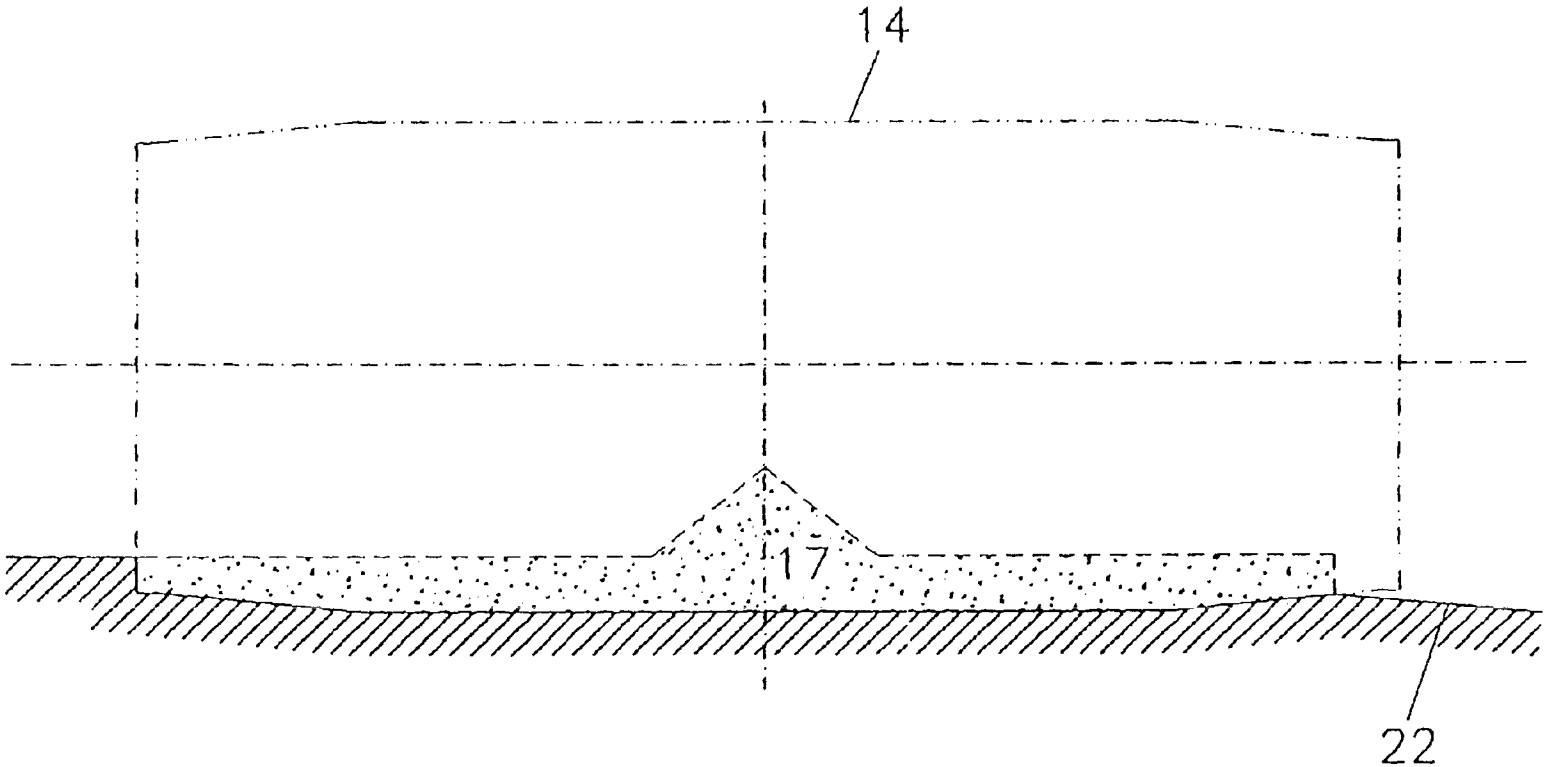
FIG. 3 is a view of the arrangement of the mini-disk bits and the conveying screws on the basic body of the cutting roller as a developed view according to FIG. 2.

The mini-disk bits 7, 8 are arranged on the sides of the conveying screws 10, 11 and 12, 13 pointing toward the middle of the roller. Their bit holders are fastened to the conveying screws 10, 11 and 12, 13. The mini-disk bits 7, 8 are arranged in terms of their distance from the axis of rotation such that their wedge tips project beyond the outer circumference of the conveying screws 10, 11 and 12, 13. This is necessary because the mini-disk bits 7, 8 must first penetrate into the soil by a defined amount before the material breaks out of the soil. The connection of the virtual path diameters 14 formed by the wedge tips of the mini-disk bits 7, 8 forms according to FIG. 3 a closed profile consisting of a cylindrical jacket, which is joined on both sides by outwardly tapering truncated cone-shaped jackets. It is achieved as a result that a smaller amount of material is to be separated either at one end of the roller or at both ends of the roller in the critical free-cutting area. FIGS. 1 and 3 shows the mining technology in blocks 17 from right to left, so that free-cutting of the cutting roller is necessary on the left-hand side. The material that remains in place on the outer sides of the cutting roller in relation to the middle area can be removed without problems during the mining of the subjacent layer from the middle area of the cutting roller, because the subjacent blocks are laterally offset in relation to the upper ones and the elevation will then be located in the middle area of the cutting roller.

To reach good mining output in the edge areas as well, the mini-disk bits 8 are placed more closely to one another there than are the mini-disk bits 7 in the middle wall area.

Figure 4:
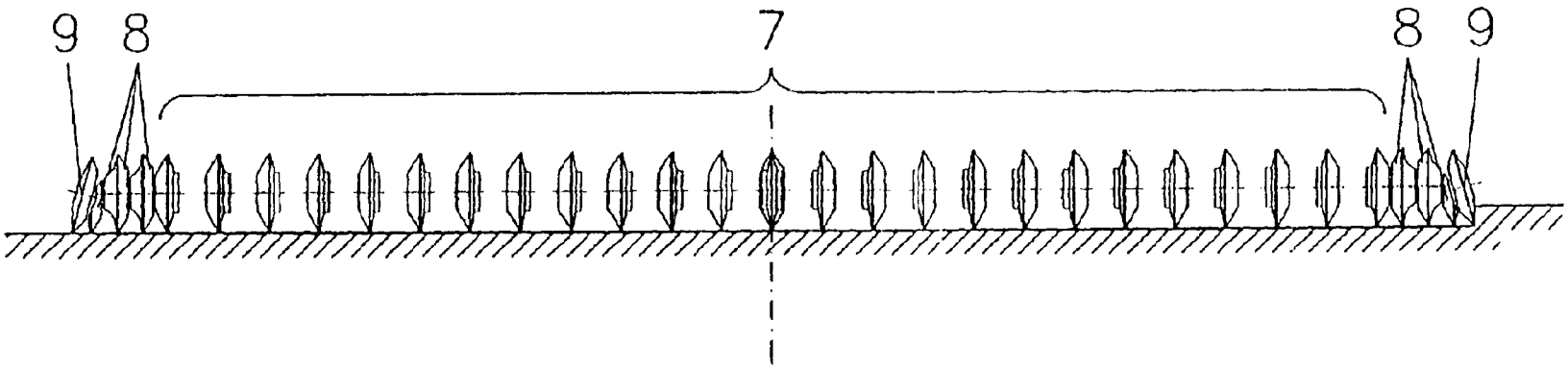
FIG. 4 is a view showing the virtual path diameter of the mini-disk bits and the cross section of the track level surface after the mining operation with the cutting roller in the direction of mining.

Furthermore, two mini-disk bits 9 each, which are arranged offset by 180° in relation to one another, are provided according to FIGS. 2 and 4 as free-cutting bits to achieve a sufficient free-cutting in the outer rolling paths of both edge areas. Their cutting edges are sloped toward the outside. The slope angle is either equal to or greater than the angle of the outer wedge flank of the mini-disk bits 8. The mini-disk bits 9 used for the free-cutting are arranged between two conveying screws 10, 11 and 12, 13. An additional conveying screw 18, 19, 20, 21 is provided in the direction of rotation of the cutting roller after each of the free-cutting bits 9 in the area of the larger drum diameter to improve the transverse conveying of the material.

The wedge flanks of the disk bodies of the mini-disk bits 7, 8, 9 are asymmetrical. The material is always split out of the solid soil during the cutting process on the side of the wedge flank with the greater angle in relation to the perpendicular passing through the tip of the wedge.

The width of the two outer frusta of the cutting roller equals at least ¼ of the mining height $H_{Schn}$. The bit density in the edge areas $L_{RB}$ is at least twice that in the area of the middle mining front $L_M$, the working face. To destroy solid orb materials in the repeatedly blocked separation operation, to path distances $t_B$ of the mini-disk bits 7 into area of the middle mining front $L_M$ are selected according to the following formula:

$$t_B = p_\Sigma \cdot \eta_m$$

Here, $p_\Sigma$ is the sum of the penetration of the mini-disk bits in the rolling path at the beginning of the breaking operation. The average is $p_D$=15–20 mm $\eta_m$ is the mean splitting modulus at the beginning of the breaking operation. $\eta_m$=3–4 can be assumed for solid and tough earth materials and $\eta_m$=3.5–5 for solid and brittle earth materials.

The three-dimensional arrangement of the mini-disk bits 8, 9 in the edge areas $L_{RB}$ and their path distances are set according to the so-called free-cut. $t_{BR}=(1-2)p_{\Sigma}$, and the edge mini-disk bit 8 at the conveying screws 10, 11, 12, 13 and mini-disk bits 9 at the additional conveying screws 18, 19, 20, 21 are arranged in the same rolling paths and are directed with the driving wedge flanks toward the outside (FIG. 2 and FIG. 4). The number of disk bits arranged in each rolling path of the edge area $L_{RB}$ is doubled and these disk bits arc ranged on the width of the edge area $L_{RB}$ higher by one depth of cut of the edge bits than in the wall area.

After the separation, the material is conveyed by means of the conveying screws 10, 11, 12 and 13 and the additional conveying screws 18, 19, 20, 21 at right angles to the middle of the roller. Due to the sloped track level surface 22 in the flank area according to FIG. 3 of the cutting roller, the volume removed is smaller here and the clearing ability is better due to elevated conveying screws, so that no opportunity will develop for the formation of an accumulation of separated material beside the mining front. The splitting away of the specific amount of path, which splitting away is directed laterally toward the inside, contributes to this as well. The edges of the track level that were left in place are also removed nearly completely during the removal of the subjacent blocks, so that the rest has no effect on the overall efficiency of the technology. The material left in the edge areas as a consequence of the smaller cutting height $H_{Schn}$ is removed without problems during the removal of the subjacent blocks due to the lateral offset from the middle wall area of the cutting roller, because the most favorable conditions prevail there for the separation and the passing on of the material.

Figure 5:
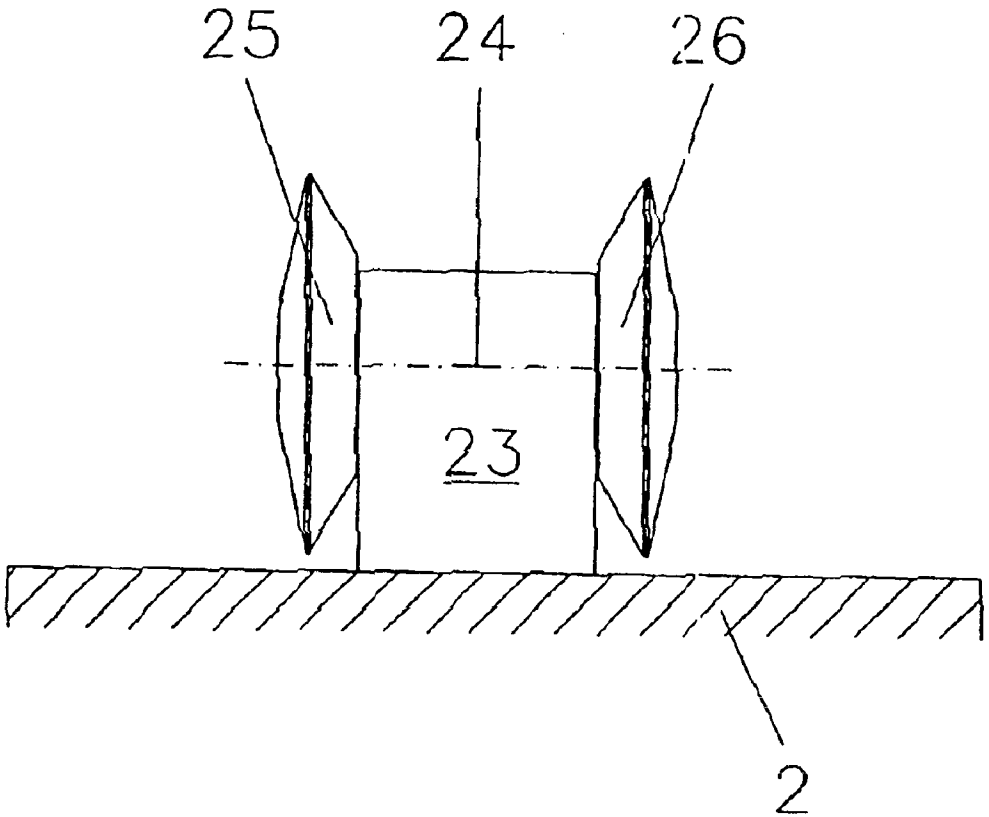
FIG. 5 is a view showing a mini-disk bit block with symmetrically arranged mini-disk bits.

Provisions are made in a second embodiment variant for the cutting roller to be equipped with mini-disk bit blocks 23. Each disk bit block 23 comprises according to FIG. 5 two mini-disk bits 25, 26 each, which are arranged in pairs and symmetrically to one another on the bit holder 24. The axial forces of the two mini-disk bits 25, 26 of one pair offset each other directly in the bit holder 24 and thus guarantee the smoother run of the entire mining member. It is important that the driving wedge flanks are arranged at the bit holder 24 in such a way that they act against each other. The distance between the two mini-disk bits 25, 26 of one disk bit block 23 is also the distance between the cutting paths shown in FIG. 2, which is to be coordinated anew each time with the particular earth material to be mined. The path distances shall also be maintained in connection with the arrangement of the disk bit blocks 23 on the conveying screws 10, 11, 12, 13 and the additional conveying screws 18, 19, 20, 21. The pressing force (normal force) is lower by about 20% and the tangential force (rolling force) by about 28% in the case of the disk bits 25, 26 arranged in pairs compared with the individual mounting of mini-disk bits 7, 8, 9. The optimal path distances of the mini-disk bits 25, 26 belonging to one pair can be maintained by selecting different lengths for their common axis without complicated conversions.

While specific embodiments of the invention have been shown and described in detail to illustrate the application of the principles of the invention, it will be understood that the invention may be embodied otherwise without departing from such principles.

What is claimed is:

1. A mining member provided as a cutting roller for a continuously operating surface miner for mining mineral raw materials possessing solid and abrasive properties; the mining member comprising:

a cylindrical or substantially cylindrical roller basic body for providing a cutting roller support;

a drive for rotating said roller basic body;

supports fastening said roller basic body to the surface miner;

a roller jacket disposed around said roller basic body, said jacket having mini-disk bits arranged in rolling paths, and conveying screws having opposite pitches and extending from two edges of the roller to the middle of the roller to form two roller halves, which are symmetrical to one another providing a mineral raw material cutting roller for block cutting with a larger middle area forming a mining front joined on both sides by edge areas, the cutting roller rolling paths providing a circumferential interface with a middle cylinder joined on both sides by outwardly tapering frusta, said frusta having a length equal to at least 0.25 of a mining height ($H_{Schn}$), and said conveying screws on the roller halves being arranged symmetrically with respect to said circumferential interface, and said conveying screws on one of the roller halves being arranged offset in relation to said conveying screws on the other roller half by an amount and said mini-disk bits are provided either directly on or after sides of said conveying screws pointing to the middle of the cutting roller in the direction of rotation of the roller, wherein a driving wedge flank of each of said mini-disk bits are directed against each other in the middle cylinder wall area of the two roller halves and said mini-disk bit on both sides of said frusta is directed inwardly, and said mini-disk bits arranged at the two outer edges are free-cutting bits, which point toward the outside with their wedge flanks.

2. A cutting roller in accordance with claim 1, wherein said mini-disk bits on said two halves of the middle cylinder wall area adjacent said conveying screws are selected with a path distance that is determined according to the following equation:

$$t_B=p_{\Sigma}\cdot\eta_m,$$

where $p_{\Sigma}$ can be assumed to equal 15–20 mm and $\eta_m$ can be assumed to equal 3–4 for solid and brittle earth materials and $\eta_m$=3.5–5 for solid and tough earth materials.

3. A cutting roller in accordance with claim 1 wherein a density of said mini-disk bits in the two edge areas on the frustum length ($L_{RB}$) is at least twice the number of said mini-disk bits in the middle wall area $L_M$, and said conveying screws on the frustum length ($L_{RB}$) are higher by the depth of penetration of said mini-disk bits in the two edge areas on the frustum length ($L_{RB}$) than said conveying screws and a set of additional conveying screws in the middle wall area ($L_M$).

4. A cutting roller in accordance with claim 1, wherein said roller body is equipped on its frustum areas with a set of additional conveying screws and a set of free-cutting mini-disk bits in the outer rolling path are arranged at an angle that is equal to or greater than the angle of the outer wedge flank of said mini-disk bit sloped toward the outside.

5. A cutting roller in accordance with claim 1, wherein said conveying screws extend over the entire length of the respective roller half.

6. A cutting roller in accordance with claim 1, wherein two said mini-disk bits are arranged in pairs on a common bit holder, and said bit holders are arranged either directly on said conveying screws and a set of additional conveying screws or behind said conveying screws and said additional conveying screws in the direction of rotation of the roller and the distance between said wedge flanks of said mini-disk bits of one pair is also a cutting path distance.

7. A cutting roller in accordance with claim 1, wherein to obtain different path distances of said mini-disk bits belonging to one pair, a set of axes of adapted lengths are used.

8. A cutting roller for a continuously operating surface miner for mining mineral raw materials of high strength, the cutting roller comprising:

a roller body with conveying screws having opposite pitches end extending from two respective edges of the roller to the middle of the roller to form roller halves with a set of conveying screws on one of the roller halves being arranged offset in relation to said conveying screws on the other roller half and with mini-disk bits mounted on each conveying screw to form rolling paths with said mini-disk bits at edge areas placed at a greater density than mini-disk bits in a middle area, with said mini-disk bits at the two outer edges of the cutting roller being directed obliquely toward the outside as free-cutting bits, said mini-disk bits having a mining height with the rolling paths together forming a virtual cutting roller body having a middle cylinder joined on both sides by outwardly tapering frusta, said frusta having a length equal of at least 0.25 of said mining height.

9. A cutting roller in accordance with claim 8, wherein said mini-disk bits are on conveying screws with a path distance that is determined according to the following equation:

$$t_B = p_\Sigma \cdot \eta_m,$$

where $p_\Sigma$ can be assumed to equal 15–20mm and $\eta_m$ can be assumed to equal 3–4for solid and brittle earth materials and $\eta_m$=3.5–5 for solid and tough earth materials.

10. A cutting roller in accordance with claim 8, wherein a density of said mini-disk bits in the two edge areas on the frustum length ($L_{RB}$) is at least twice the number of said mini-disk bits in the middle wall area $L_M$, and said conveying screws on the frustum length ($L_{RB}$) are higher by the depth of penetration of said mini-disk bits in the two edge areas on the frustum length ($L_{RB}$) than said conveying screws and a set of additional conveying screws in the middle wall area ($L_M$).

11. A cutting roller in accordance with claim 8, wherein said roller body is equipped on its frustum areas with a set of additional conveying screws and a set of free-cutting mini-disk bits in the outer rolling path are arranged at an angle that is equal to or greater than the angle of the outer wedge flank of said mini-disk bit sloped toward the outside.

12. A cutting roller in accordance with claim 8, wherein said conveying screws extend over the entire length of the respective roller half.

13. A cutting roller in accordance with claim 8, wherein two said mini-disk bits are arranged in pairs on a common bit holder, and said bit holders are arranged either directly on said conveying screws and a set of additional conveying screws or behind said conveying screws and said additional conveying screws in the direction of rotation of the roller and the distance between the wedge flanks of said mini-disk bits of one pair is also a cutting path distance.

14. A cutting roller in accordance with claim 8, wherein to obtain different path distances of said mini-disk bits belonging to one pair, a set of axes of adapted lengths are used.

15. A cutting roller member for a surface miner for mining mineral raw materials possessing solid and abrasive properties, the cutting roller member comprising:

a drive;

surface miner supports;

a roller jacket, connected to said supports and driven by said drive;

a first side conveying screw extending from a first roller jacket edge to the middle of said roller jacket;

a second side conveying screw extending from a second roller jacket edge to the middle of said roller jacket, said second side conveying screw having a pitch that is opposite a pitch of said first side conveying screw and being offset so as to not intersect in the middle;

a set of mini-disk bits providing a mining height, said mini-disk bits being arranged in roller paths along said first conveying screw and said second conveying screw, said mini-disk bits forming a virtual cutting roller body with a symmetrical profile having a cylindrical middle area and frusta shaped at each side of the virtual cutting roller body with reduced radial dimension at side edges of the virtual cutting roller body, each said frusta having an axial length that is at least a quarter of the mining height, said mini-disk bits in said cylindrical middle wall area having wedge flanks in one half of said cylindrical middle wall area directed outwardly and opposite wedge flanks in the other half of said cylindrical middle wall area and each respective wedge flank for said mini-disk bits in each frusta area being directed inwardly, and mini-disk bits at said side edges being free-cutting bits with wedge flanks directed outwardly.

16. A cutting roller member in accordance with claim 15, wherein said mini-disk bits on two halves of the cylindrical middle wall area adjacent said conveying screws are selected with a path distance that is determined according to the following equation:

$$t_B = p_\Sigma \cdot \eta_m,$$

where $p_\Sigma$ can be assumed to equal 15–20mm and $\eta_m$ can be assumed to equal 3–4 for solid and brittle earth materials and $\eta_m$=3.5–5 for solid and tough earth materials.

17. A cutting roller member in accordance with claim 15, wherein a density of said mini-disk bits in the two edge areas on the frustum length ($L_{RB}$) is at least twice the number of said mini-disk bits in the middle wall area $L_M$, and said conveying screws on the frustum length ($L_{RB}$) are higher by the depth of penetration of said mini-disk bits in the two edge areas on the frustum length ($L_{RB}$) than said conveying screws and a set of additional conveying screws in the middle wall area ($L_M$).

* * * * *